United States Patent [19]

Kvistad

[11] Patent Number: 4,543,871

[45] Date of Patent: Oct. 1, 1985

[54] PERCUSSION BAR INSTRUMENT

[76] Inventor: Garry M. Kvistad, R.D. 1, Box 381A, West Hurley, N.Y. 12491

[21] Appl. No.: 524,378

[22] Filed: Aug. 18, 1983

[51] Int. Cl.[4] ..... G10D 13/08

[52] U.S. Cl. ..... 84/403

[58] Field of Search ..... 84/402–404, 84/408; 116/148, 169

[56] References Cited

U.S. PATENT DOCUMENTS

| | | | |
|---|---|---|---|
| 408,655 | 8/1889 | Deagan et al. | 84/403 |
| 2,458,462 | 1/1949 | Zimmerman | 84/403 |
| 2,821,956 | 2/1958 | Wold | 116/169 |
| 2,862,412 | 12/1958 | Kreizel | 84/403 |
| 2,943,527 | 7/1960 | Hanert | 84/403 |
| 3,138,986 | 6/1964 | Musser | 84/410 |
| 3,595,119 | 7/1971 | Kuijpers | 84/403 |
| 3,731,580 | 5/1973 | Suzuki | 84/403 |

*Primary Examiner*—Benjamin R. Fuller

*Attorney, Agent, or Firm*—John Maier, III

[57] ABSTRACT

A percussion bar instrument including cradles slidably mounted on a mounting base to hold percussion bars of varying lengths in a variety of arrangements with each bar held at its nodal points.

14 Claims, 3 Drawing Figures

PERCUSSION BAR INSTRUMENT

FIELD OF THE INVENTION

This invention relates generally to percussion bar instruments.

STATEMENT OF THE PRIOR ART

Various bar percussion instruments are known in the art as for example the Musser Patent, U.S. Pat. No. 3,138,986 and the Kreizel Patent, U.S. Pat. No. 2,862,412. However, in these patents, the various bars are placed in the sequence of a normal scale requiring that the player strike the bars in accordance with standard music and not in the order in which the bars are located in relationship to one another.

Both of these patents show a tapered design where the next adjacent bar to any bar is either the next shortest or the next longer bar. If a pair of strings are provided to hold the bars together, the lines formed by the strings are tapered due to change in length of each successive bar and therefore only hold the bar at an angle resulting in a compromise of its true nodal point.

One patent, namely the Hanert Patent, U.S. Pat. No. 2,943,527, does provide parallel supports for a percussion bar instrument with the object in mind of making it possible to arrange the bars out of the normal sequence so that if one contiguous bar after another is struck, a tune will result. However, Hanert produced bars substantially of the same length. He provided, however, that each bar could be interchanged so that by rearrangement, the order in which the bars were placed upon the support would produce a different tune or melody when struck in contiguous and sequential order. In this way, Hanert makes possible a simple machine for children who were learning to keep time but who were not yet able to have the skill to play what is best be described as a standard percussion bar instrument.

However, even with the design proposed by Hanert, a compromise is produced in tone quality as bars of substantially the same length are required and the tone change is obtained only by variations in the thickness and width of the various bars. Furthermore, the bars are not suspended and only rest upon mounting means provided.

The principle object of this invention is to provide a percussion bar instrument in which percussion bars of varying lengths can be placed in any number of different sequences and a wide variety of sequences therefore making it possible to play a melody by striking the bars in contiguous and sequential order, that is to say one right next to the other, and also to provide tones distinct from the standard scale while at the same time having an instrument where each bar is fully suspended at its proper nodal point notwithstanding the length of the adjacent bar or bars.

Other objects of this invention will in part be obvious and in part hereafter pointed out.

The invention clearly consists of the features of construction, combination of elements and arrangements of parts which will be exemplified in the construction hereinafter described of which the scope of application will be indicated in the following claims.

SUMMARY OF THE INVENTION

This invention resides in a percussion bar instrument for utilizing percussion bars of varying lengths in a variety of arrangements. Each of the percussion bars is held at its nodal point. A mounting means is provided and a plurality of pairs of cradles are slidably mounted in the mounting means, each pair of the cradle means being aligned with one another. Each percussion bar is mounted in one pair of cradles.

The novel features which are considered as characteristic of the invention are set forth with particularity in the appended claims.

The invention itself, however, as to its construction and obvious advantages will be best understood from the following description of the specific embodiment when read with the accompanying drawings.

BRIEF DESCRIPTION OF THE DRAWINGS

In the accompanying drawings, wherein like reference characters identify the same or like part, there are shown three separate views of this invention.

DESCRIPTION OF THE PREFERRED EMBODIMENT

Figure 1:
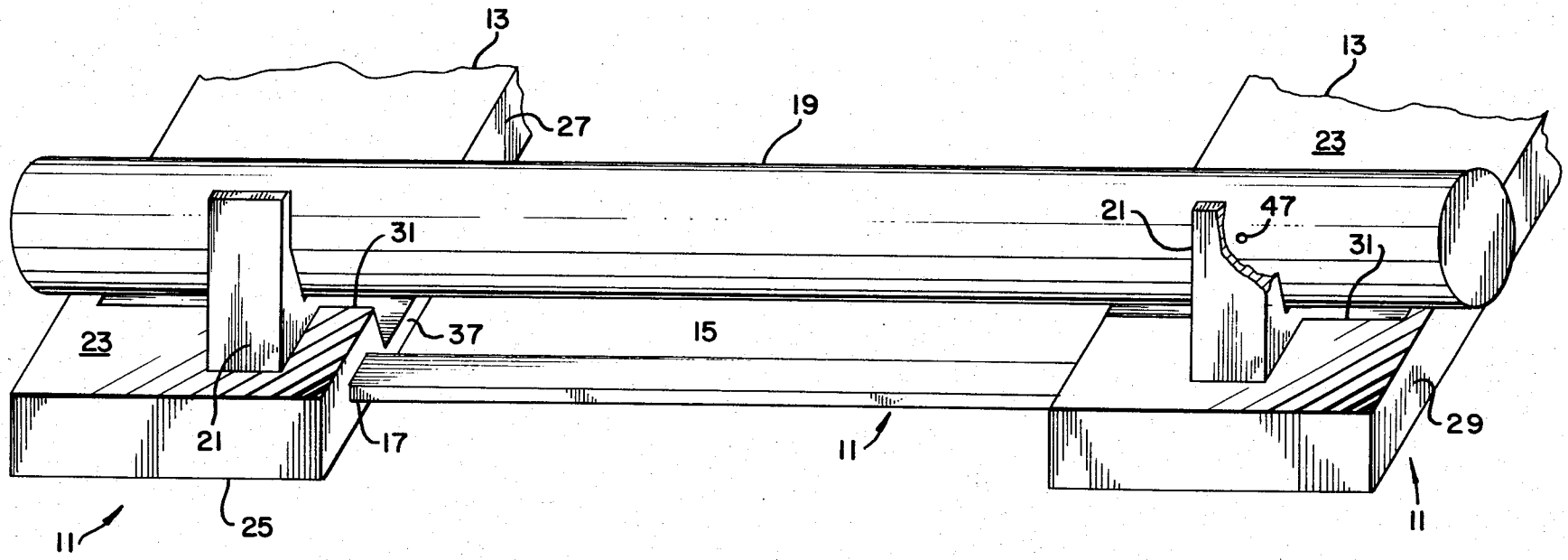
FIG. 1 is a perspective view showing a portion of the mounting means with one pair of cradles slidably mounted in the mounting base and with one percussion bar in place, one cradle being broken to show the opening in the bar for retaining the bar in the cradle.

Referring now to FIG. 1, a mounting means 11 is shown including a pair of mounting members 13. Each mounting member 13 is held in a spaced relationship to the other by one or more cross members 15. Each cross member 15, as shown, can be fitted into a lower groove 17 (not shown) or other suitable opening in each of the mounting members 13. In this way, the length of the cross member 15 can be varied, as best seen in a comparison between FIG. 1 and FIG. 2, and by varying the length of the cross member 15, either longer or shorter percussion bars 19 can be utilized with the same mounting members 13 and cradles 21.

Each mounting member 13 has an upper surface 23 and a lower surface 25. The mounting members 13 are preferably rectangular in cross section and also have an inner surface 27 and an outer surface 29. The inner surfaces 27 of each pair of mounting members 13 face or oppose one another when connected to the cross member 15 as previously explained. The mounting members 13 are elongated and can be made in any length desired depending upon the number of percussion bars 19 which are to be mounted. In each mounting member 13 a series of spaced upper grooves 31 are formed in the upper surface 23 at right angles to the longitudinal axis of each mounting member 13. Each of the upper grooves 31 extends from the opposing inner surfaces 27 at least a major portion of the distance to the outer surface 29 and the upper grooves 31 are substantially parallel to one another. Each of the upper grooves 31 in each mounting member 13 has a corresponding upper groove 31 in the other mounting member 13 of the pair of mounting members 13 forming the mounting means 11. Each of the upper grooves 31 are so located to form a pair of upper grooves 31 which in the pair of mounting members are aligned with one another, each mounting member 13 having an upper groove 31 aligned with another upper groove 31 in the other mounting member 13. Therefore, for each upper groove 31 in one mounting member 13, there is an aligned upper groove 31 in the other mounting member 13.

The cross section 31 of each of the upper grooves 31 has a dove-tailed, cross sectional area with the upper dimension at the upper surface 23 of each mounting member 13 being narrower than the base dimension 37.

Figure 3:
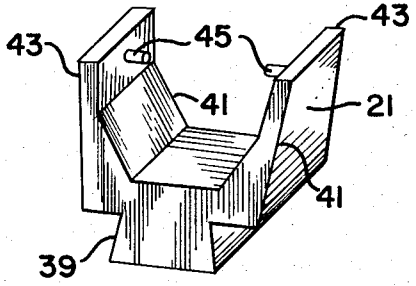
FIG. 3 is a perspective view of only the cradle.

Each cradle 21 is slidably fitted into each of the upper grooves 31 and, as best seen in FIG. 3, includes a base portion 39 with two cradle arms 41 extending upwardly. The cradle 21 is preferably symmetrical. The base portion 39 is also dove-tailed having its lower surface also being wider than the upper dimension where the base portion 39 joins the cradle arms 41 and having the same dimensions as to be adapted slidably to fit in an upper groove 31. Each of the cradle arms 41 extend upwardly and at its upper ends 43 has a pair of opposing nodal pins 45 which are two small pins aligned with one another and opposing one another. The cradle 21 is preferably made of a semi-hard rubber so as to be strong enough to hold a percussion bar 19 but still flexible enough to be able to pull back for clamping the percussion bar 19 as is hereafter explained and to not cause any vibrational clamping thus allowing free vibration of the bar it supports.

Before beginning a discussion of the completed instrument a definition of some of the terms used for a percussion bar instrument are important. The bar 19 itself means either a bar, plate or tube made of any material and used as the sounding part of the percussion instrument itself. The node is the point on the vibrating body which is a bar, which has minimum movement. The anti-node on the other hand is the point on the vibrating body with maximum movement.

Figure 2:
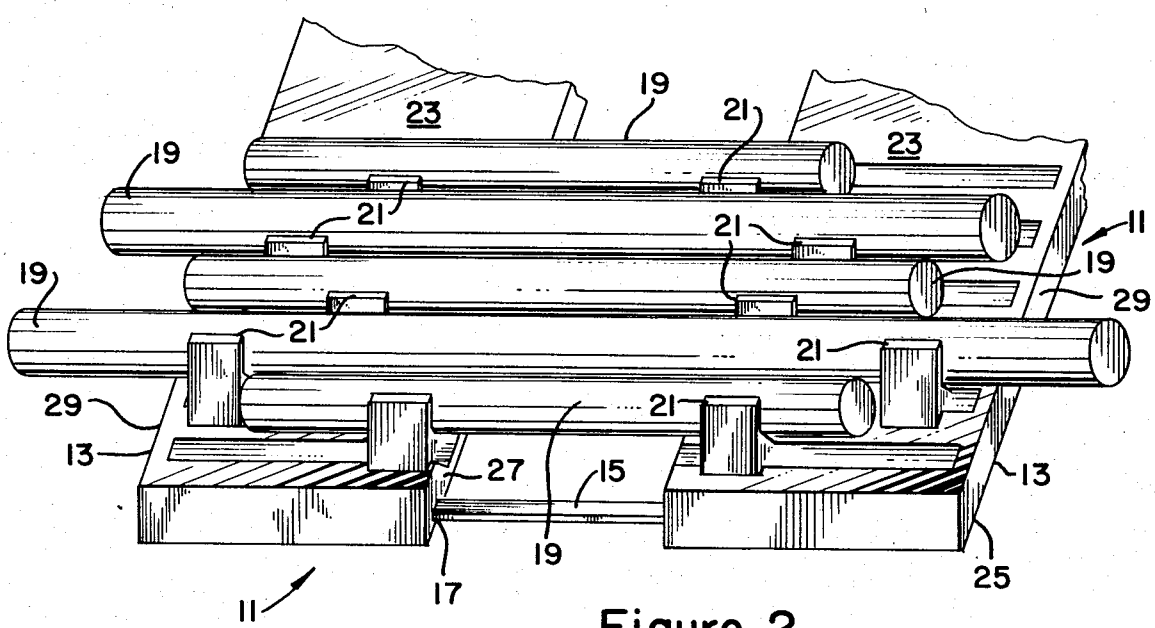
FIG. 2 is a perspective view of the percussion instrument showing a series of bars of various lengths mounted in a series of bars of cradles.

In FIG. 2, the bars 19 are shown as circular tubes. However, a bar 19 in the form of a plate can be supported the same way as would be a solid bar regardless of cross section. In each bar 19, two opposing holes 47 should be made exactly at the nodal point. The outside nodal length is the distance between the end of the bar 19 and the nearest nodal point and this distance is the same for both ends of the bar. The distance between the two nodal points is the inside nodal length.

Each of the cradles in a pair of cradles 21 must be separated so that the nodal pins 45 of each cradle 21 are located apart from one another for a distance which must be the inside nodal length. Each bar has a pair of opposing nodal openings 47 at both nodal points adapted to receive the nodal pins 45 of the cradle 21. The openings are small resulting in a minimal amount of material being removed thereby having a noticable effect upon tone. The bar 19 is then clipped in place by spreading the cradle arms 41 of both cradles 21 sufficiently so that the nodal pins 45 will enter the nodal openings or opposing holes 47. By sliding the cradles to the desired position the next bars 19 can be of any length within the range provided by the cross member 15 and the length of each pair of upper grooves 31.

By use of the percussion bar instrument, according to this invention, each bar 19 is securely held in place and is fully suspended at its exact nodal point without compromise due to holding the bar 19 at an angle at the nodal point. Each bar 19 can be of any length and there is no essential restriction in the order in which the percussion bars are placed. Of even greater importance, the arrangement of the bars 19 can be easily and quickly changed.

The operation and use of the invention hereinabove described will be evident to those skilled in the art to which it relates from the consideration of the foregoing.

It will thus be seen that there is provided a device in which several objects of this invention are achieved and which is well adapted to meet the conditions of practical use. Its advantages are easily seen.

It is thought that persons skilled in the art to which this invention relates will be able to obtain a clear understanding of the invention after considering the foregoing description in connection with the accompanying drawings. Therefore, a more lengthy description is to be deemed unnecessary.

The invention may be embodied in other specific forms without departing from the spirit or essential characteristics thereof. The present embodiments are, therefore, to be considered in all aspects as illustrative and not restrictive. The scope of the invention is indicated by the appended claims rather than the foregoing description and all changes which come within the meaning of range and equivalency of the claims are, therefore, intended to be embraced therein.

I claim:

1. A percussion bar instrument for utilizing percussion bars of varying lengths in a variety of arrangements with each bar held at its nodal points, said percussion bar instrument comprising:

a pair of mounting members with a plurality of opposing upper grooves in each member;

means for holding the pair of mounting members in a spaced relationship to one another;

a plurality of cradles each slidably mounted in the upper grooves of the pair of mounting members and including an opposing pair of nodal pins; and percussion bars mounted in said cradles, each percussion bar having a pair of opposing openings at its nodal points adapted to receive the nodal pins of the cradles.

2. A percussion bar instrument according to claim 1 wherein the mounting members have an upper surface and a lower surface and an inner surface and an outer surface, said upper grooves being located in the upper surface and extending from the inner a major portion of the distance to the outer surface.

3. A percussion bar instrument according to claim 1 wherein the mounting members have an upper surface and a lower surface and an inner surface and an outer surface, said upper grooves being located in the upper surface and extending from the inner surface for a major portion of the distance to the outer surface, each upper groove in each mounting member being aligned with an upper groove in the other mounting member of the pair of mounting members.

4. A percussion bar instrument according to claim 1 wherein the mounting members have an upper surface and a lower surface and an inner surface and an outer surface, said upper grooves being located in the upper surface and extending from the inner surface for a major portion of the distance to the outer surface, each upper groove in each mounting member being aligned with an upper groove in the other mounting member of the pair of mounting members, each of the upper grooves having a dovetail cross-section.

5. A percussion bar instrument according to claim 1 wherein said means for holding the pair of mounting members in a spaced relationship to one another includes at least one cross bar member rigidly affixed to both mounting members.

6. A percussion bar instrument according to claim 1 wherein said means for holding the pair of mounting members in a spaced relationship to one another includes at least one cross bar member rigidly affixed to both mounting members, the cross bar member being substantially at right angles to both mounting members of the pair of mounting members.

7. A percussion bar instrument according to claim 1 wherein each of the upper grooves has a dovetail cross-section and the cradle has a dovetail base adapted slidably to fit in each upper groove.

8. A percussion bar instrument according to claim 1 wherein each of the upper grooves has a dovetail cross-section and the cradle has a dovetail base adapted slidably to fit in each upper groove, each cradle having a pair of symmetrically located cradle arms extending upwardly from the dovetail base with a pair of opposing nodal pins extending horizontally from the cradle arms adjacent the upper ends of the cradle arms, the pair of cradle arms being flexible.

9. A percussion bar instrument for utilizing percussion bars of varying lengths in a variety of arrangements with each bar held at its nodal points, said percussion bar instrument comprising:

a pair of mounting members, each with a longitudinal axis, and an upper surface and a lower surface, an inner and an outer surface and outer side surface, each longitudinal axis being substantially parallel to the other, each mounting member having a plurality of upper grooves therein in the upper surface and substantially at right angles to the longitudinal axis of the mounting member and each upper groove having a dovetail cross-section and each upper groove extending from the inner side a major portion of the width of the mounting member toward the outer surface, each mounting member having at least one lower groove, each lower groove extending from the inner surface toward the outer surface and substantially at right angles to the longitudinal axis of the mounting member;

a cross member including an elongated member rigidly secured in the lower groove in each mounting member of the pair of mounting members for holding the pair of mounting members in a spaced relationship;

a cradle slidable mounted in each upper groove, each cradle having a dovetail base adapted slidably to fit in each upper groove and a pair of symmetrically located cradle arms extending upwardly from the dovetail base with a pair of opposing nodal pins extending horizontally from the cradle arms adjacent the upper ends of the cradle arms, the pair of cradle arms being flexible, each upper groove in each mounting member being aligned with an upper groove in the other mounting member of the pair of mounting members; and percussion bars mounted in said cradles, each percussion bar having a pair of opposing openings at its nodal points adapted to receive the nodal pins of a pair of cradles slidably mounting in aligned upper grooves of the pair of mounting members.

10. A percussion bar instrument for utilizing percussion bars of varying lengths in a variety of arrangements with each bar held at its nodal points, said percussion bar instrument comprising:

a mounting means, said mounting having a plurality of grooves therein substantially parallel to one another and in a spaced relationship to one another;

a plurality of pairs of cradle means slidably mounted on the mounting means, said cradle means being slidably mounted in said grooves, each one of the two cradle means forming a pair of cradle means being aligned with one another; and a percussion bar mounted in each pair of cradles.

11. A percussion bar instrument for utilizing percussion bars of varying lengths in a variety of arrangements with each bar held at its nodal points, said percussion bar instrument comprising:

a mounting means having a plurality of upper grooves therein substantially parallel to one another and in a spaced relationship to one another;

a plurality of pairs of cradle means slidably mounted in said upper grooves, each of the upper grooves having a dovetail cross-section, each one of the two cradle means forming a pair of cradle means being aligned with one another; and a percussion bar mounted in each pair of cradles.

12. A percussion bar instrument for utilizing percussion bars of varying lengths in a variety of arrangements with each bar held at its nodal points, said percussion bar instrument comprising:

a mounting means;

a plurality of pairs of cradle means slidably mounted on the mounting means, each one of the two cradle means forming a pair of cradle means being aligned with one another, each cradle means including a base and a pair of cradle arms extending upwardly from the base with a pair of opposing nodal pins extending horizontally from the cradle arms adjacent the upper ends of the cradle arms, the cradle arms being flexible; and a percussion bar mounted in each pair of cradles.

13. A percussion bar instrument for utilizing percussion bars of varying lengths in a variety of arrangements with each bar held at its nodal points, said percussion bar instrument comprising:

a mounting means having a plurality of upper grooves therein substantially parallel to one another and in a spaced relationship to one another;

a plurality of pairs of cradle means slidably mounted in said upper grooves, each one of the two cradle means forming a pair of cradle means being aligned with one another, each cradle means including a base and a pair of cradle arms extending upwardly from the base with a pair of opposing nodal pins extending horizontally from the cradle arms adjacent the upper ends of the cradle arms, the cradle arms being flexible; and a percussion bar mounted in each pair of cradles.

14. A percussion bar instrument for utilizing percussion bars of varying lengths in a variety of arrangements with each bar held at its nodal points, said percussion bar instrument comprising:

a mounting means having a plurality of upper grooves therein substantially parallel to one another and in a spaced relationship to one another with each upper groove having a dovetail cross-section;

a plurality of pairs of cradle means slidably mounted in said upper grooves, each cradle means including a base and a pair of cradle arms extending upwardly from the base with a pair of opposing nodal pins extending horizontally from the cradle arms adjacent the upper ends of the cradle arms, the cradle arms being flexible and each base having a dovetail cross-section; and a percussion bar mounted in each pair of cradles.

* * * * *